US008429906B2

(12) United States Patent
Rippert

(10) Patent No.: US 8,429,906 B2
(45) Date of Patent: Apr. 30, 2013

(54) SINGLE-WALL MANIFOLD

(75) Inventor: Nils Rippert, Gross-Umstadt (DE)

(73) Assignee: Friedrich Boysen GmbH & Co. KG, Altensteig (DE)

( * ) Notice: Subject to any disclaimer, the term of this patent is extended or adjusted under 35 U.S.C. 154(b) by 504 days.

(21) Appl. No.: 12/640,706

(22) Filed: Dec. 17, 2009

(65) Prior Publication Data

US 2010/0162692 A1 Jul. 1, 2010

(30) Foreign Application Priority Data

Dec. 18, 2008 (DE) ..... 10 2008 063 744

(51) Int. Cl.
*F01N 1/00* (2006.01)

(52) U.S. Cl.
USPC ..... 60/323; 60/313; 60/322; 60/324

(58) Field of Classification Search ..... 60/272, 60/312, 313, 322, 323, 324
See application file for complete search history.

(56) References Cited

U.S. PATENT DOCUMENTS

| | | | | |
|---|---|---|---|---|
| 5,934,070 | A * | 8/1999 | Lagelstorfer | 60/280 |
| 6,702,062 | B2 * | 3/2004 | Kusabiraki et al. | 181/240 |
| 6,863,154 | B2 * | 3/2005 | Uegane et al. | 181/207 |
| 7,503,171 | B2 * | 3/2009 | Saito | 60/323 |
| 2011/0107753 | A1 * | 5/2011 | Leroy et al. | 60/323 |

FOREIGN PATENT DOCUMENTS

| | | | |
|---|---|---|---|
| DE | 41 34 766 | A1 | 4/1992 |
| EP | 0 582 205 | B1 | 7/1993 |
| EP | 1 589 202 | A1 | 10/2005 |
| FR | 2 849 470 | A1 | 7/2004 |
| FR | 2 870 886 | A1 | 12/2005 |
| FR | 2 930 287 | A1 | 10/2009 |
| JP | 7-233725 | A | 9/1995 |
| JP | 9-287446 | A | 11/1997 |
| JP | 409287446 | A | 11/1997 |
| JP | 2003-232211 | A | 8/2003 |
| WO | WO 02/088527 | A1 | 11/2002 |

* cited by examiner

*Primary Examiner* — Binh Q Tran

(74) *Attorney, Agent, or Firm* — Kilpatrick Townsend & Stockton LLP

(57) ABSTRACT

A single-wall manifold having an engine flange, an outlet flange and manifold pipes which are connected at their one end to the engine flange and at their other end to the outlet flange, with a load-transferring connection being provided between the engine flange and the outlet flange in addition to the manifold pipes to improve the load transfer between the outlet flange and the engine flange.

15 Claims, 3 Drawing Sheets

SINGLE-WALL MANIFOLD

CROSS-REFERENCE TO RELATED APPLICATION

Figure 1:
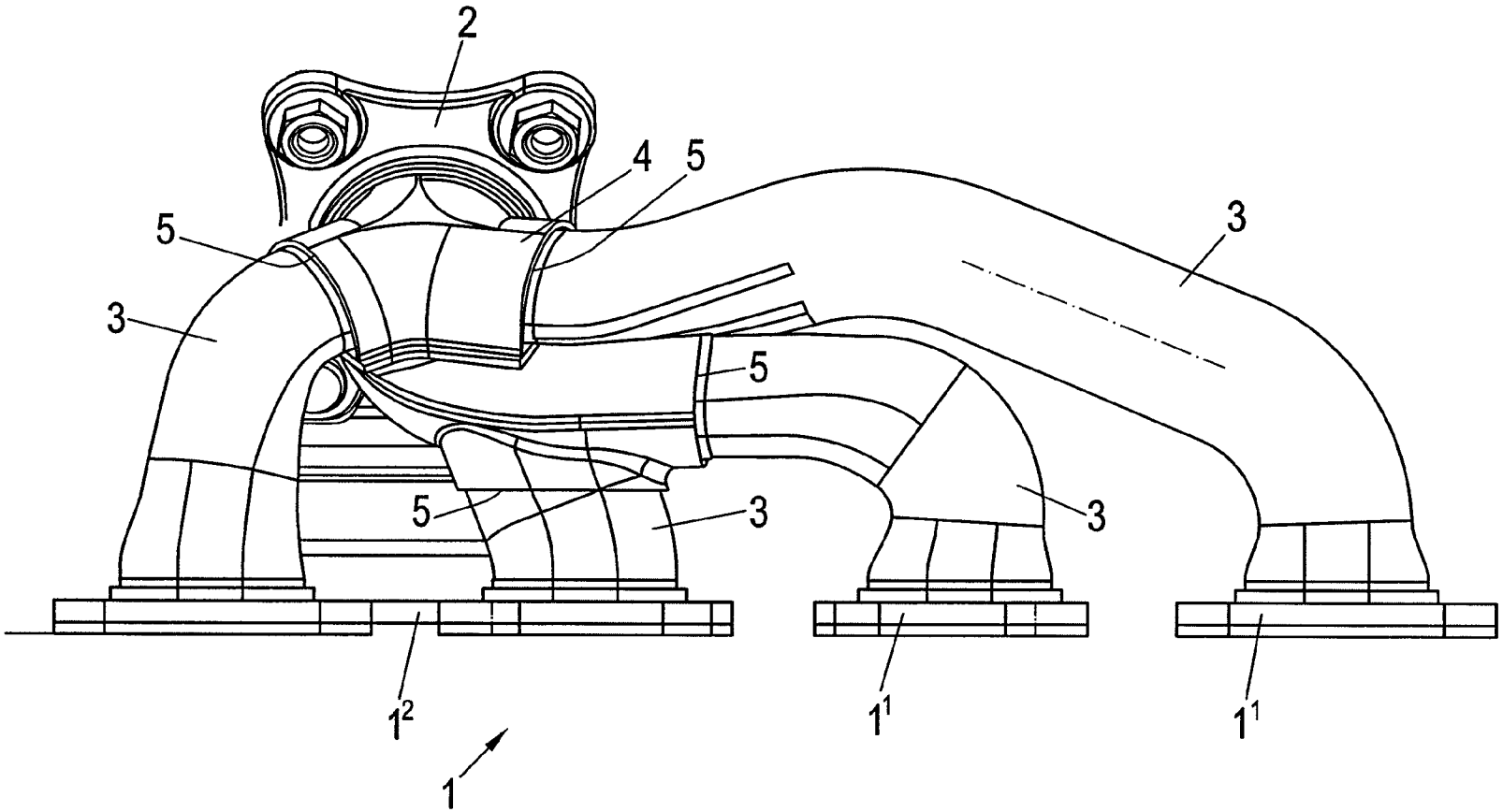

This application claims priority to German Application No. 10 2008 063 744.0, filed Dec. 18, 2008, the disclosure of which is incorporated herein by reference.

The present invention relates to a single-wall manifold having an engine flange, an outlet flange and manifold pipes which are connected at their one end to the engine flange and at their other end to the outlet flange.

While the engine flange is fixed to the engine block of a motor vehicle, the outlet flange has to be fastened in a different way to take up the load bearing on the outlet flange. The outlet flange must in particular take up a substantial load when further exhaust components such as an exhaust turbocharger or a catalytic converter close to the engine are connected to the outlet flange. A load transfer to the engine flange is generally possible via the manifold pipes. Due to the different thermal expansions of the manifold pipes as a result of their different lengths, they have to be relatively flexible, however, and are therefore less suited for a load transfer. With single-wall manifolds, there is, on the other hand, not the possibility of realizing a load transfer via an outer shell.

It is the underlying object of the invention to solve these problems.

This object is satisfied in a single-wall manifold of the initially named kind in that a load-transferring connection is provided between the engine flange and the outlet flange in addition to the manifold pipes.

The load to be taken up by the outlet flange can be transferred to the engine flange and thus to the engine block by the additional load-transferring connection between the engine flange and the outlet flange.

The load is conducted around the manifold pipes in this manner. The manifold pipes can thereby be designed to be flexible without limitation by a necessary load reception. The design of the manifold pipes can thus also be optimized by the load diversion via a connection between the outlet flange and the engine flange.

The connection between the engine flange and the outlet flange is preferably designed so that a thermal compensation is made possible between the engine flange and the outlet flange. The thermal expansions can usually not be completely taken up by the manifold pipes. There is therefore a relative movement between the outlet flange and the engine flange on heating. This is made possible by the named design of the connection.

A thermal compensation movement can in particular be made possible in that the connection between the engine flange and the outlet flange has a swept shape. An S shape has proven to be particularly suitable.

It is furthermore advantageous if the engine flange and the outlet flange are made as separate parts and are subsequently connected to one another. It is possible in this way to manufacture the two parts from different materials. The engine flange can thus preferably be manufactured of high-quality steel, in particular of austenitic steel, whereas the outlet flange can be made of less high-quality steel, in particular ferritic steel. Costs can be thereby be cut overall.

In accordance with a further embodiment of the invention, the connection between the engine flange and the outlet flange is formed by a separate part which is connected to the engine flange, on the one hand, and to the outlet flange, on the other hand, in particular by welding. This embodiment has the advantage that each part can be made separately and that also all three parts can be made of different materials. Costs can thus be cut further. The engine flange and the outlet flange can, however, also be directly connected to one another. Only two parts are thus required.

The engine flange can be made as an inlet flange for a plurality of cylinders. It is, however, also possible to form the engine flange from a plurality of single flanges or double flanges. In this case, in accordance with a further embodiment of the invention, only some of the single flanges or double flanges are connected to the outlet flange. The outlet flange can, for example, be connected to a double flange for two cylinders. One double flange is stable enough overall to take up the load from the outlet flange. The other engine flanges can thereby be designed as single flanges, whereby a material saving and thus a cutting of costs result.

The manifold pipes are preferably made flexible to be able to compensate different thermal expansions. The flexible design can in particular be effected by selection of the material and/or of the wall thickness and/or of the shape of the cross-section and/or of the pipe curvature. The thinner the wall thickness, the greater the flexibility. On the other hand, an oval cross-section results in an increased flexibility about the longitudinal axis of the oval.

The engine flange and the outlet flange can be formed as stamped parts, stamped bent parts or as forgings. The flanges can thus be manufactured cost-effectively.

Figure 2:
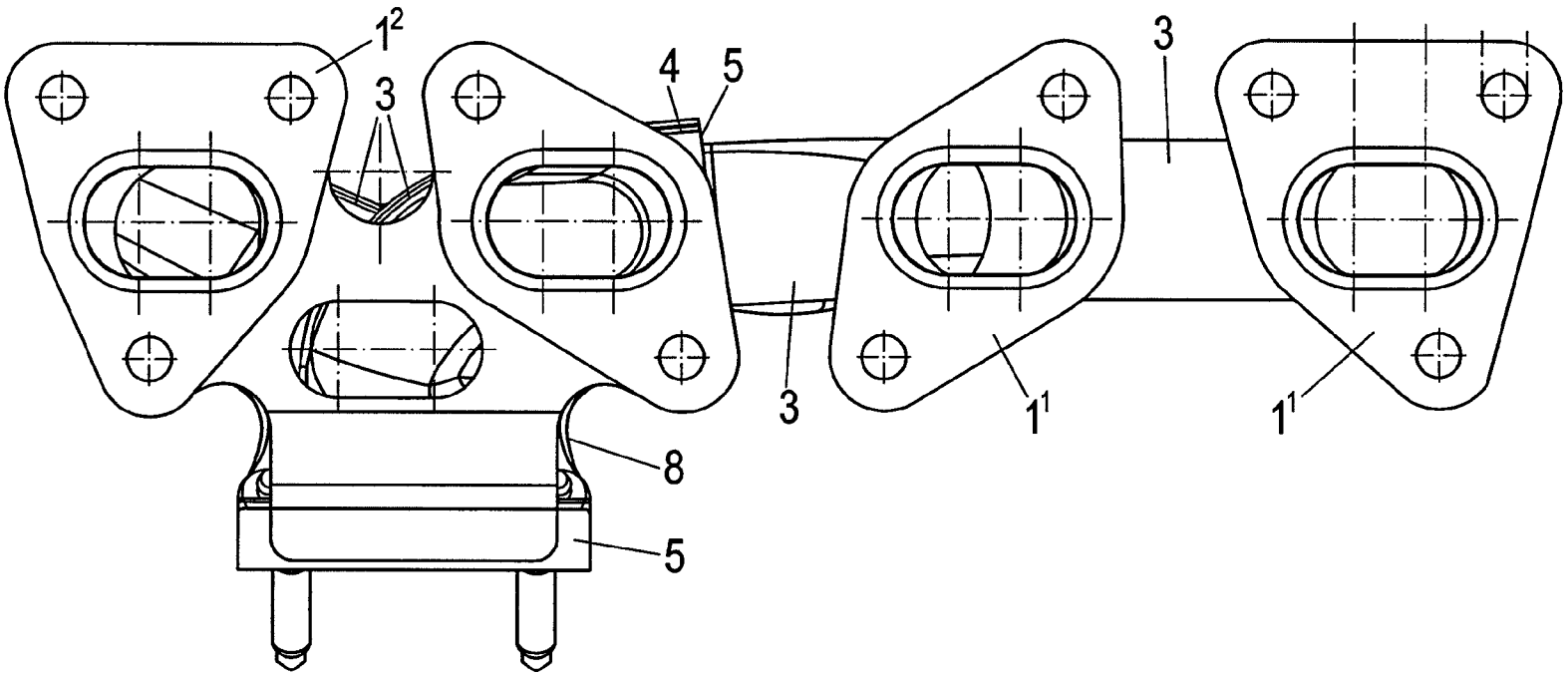

An embodiment of the invention is represented in the drawing and will be described in the following. There are shown, schematically in each case:

FIG. 1 a plan view of the upper side of an exhaust manifold in accordance with the invention;

FIG. 2 a view of the manifold of FIG. 1 rotated by 90°; and

Figure 3:
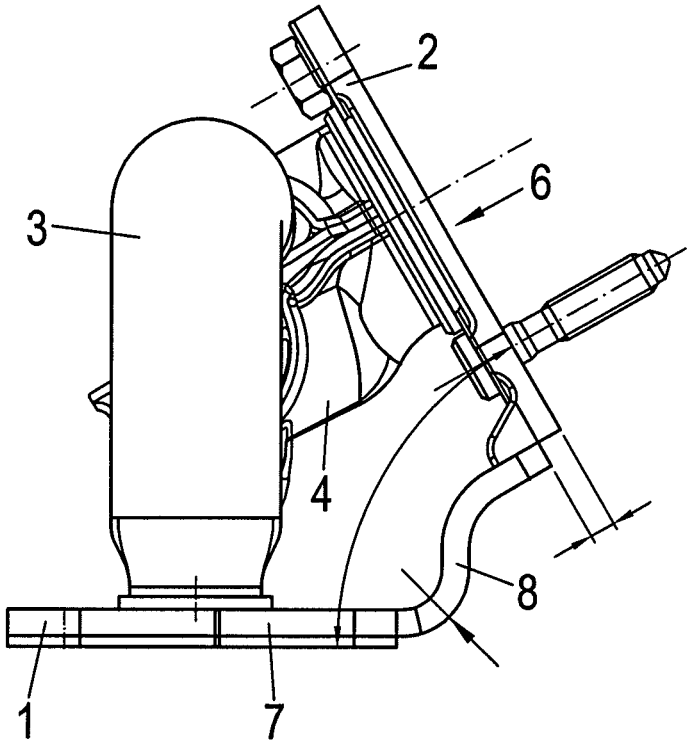

FIG. 3 a side view of the manifold of FIG. 1.

The manifold shown in the Figures and designed as a single-wall manifold includes an engine flange 1, an outlet flange 2 and four manifold pipes 3 which are each connected at their one end to the engine flange 1 and at their other end to the outlet flange 2. The manifold pipes 3 are in this respect connected via an inlet housing 4 to the outlet flange 2. That is, an inlet housing 4 which has four inlet openings 5 for the manifold pipes 3 and one outlet opening 6 which opens in the outlet flange 2 is connected to the outlet flange 2.

As can be seen, the engine flange 1 is formed by two single flanges $\mathbf{1}^1$ and one double flange $\mathbf{1}^2$. Whereas the single flanges $\mathbf{1}^1$ are only connected to the cylinder head, the double flange $\mathbf{1}^2$ is additionally connected to the outlet flange 2, as can in particular be recognized in FIG. 3. For this purpose, the double flange $\mathbf{1}^2$ also has an S-shaped curved connection section 8 beside the straight flange section 7. The double flange $\mathbf{1}^1$ is welded to the outlet flange 2 using this connection section 8. It would generally also be possible to manufacture the outlet flange 2 and the double flange $\mathbf{1}^2$ in one piece. The two-piece design has the advantage, however, that both parts can be produced from different materials. The double flange $\mathbf{1}^2$ is in particular made from austenitic steel and the outlet flange 2 from ferritic steel, that is from normal steel. On the other hand, it would also be possible to produce the connection section 8 as a further separate part and to connect it, in particular weld it, to the double flange $\mathbf{1}^2$. A separate material could then also be used for this purpose.

There is a load-transferring connection between the two components via the connection 8 between the double flange $\mathbf{1}^2$ and the outlet flange 2. The load acting on the outlet flange 2 can thereby be transferred to the double flange $\mathbf{1}^2$ and thus onto the engine block. Components such as turbochargers or catalytic converters close to the engine which are attached to the outlet flange 2 can thereby be fastened to the engine block without the manifold pipes 3 having to transfer the load. The manifold pipes 3 can thereby be optimized with respect to their flexibility, can in particular be made more flexible, to compensate different thermal expansions. The material thickness of the manifold pipes can potentially be reduced, whereby weight can be saved. In addition, the flexibility can be influenced by selection of the material of the manifold pipes 3, by selection of the shape of the cross-section and by the curvature of the pipes 3.

The single flanges $\mathbf{1}^1$ and the outlet flange 2 can be manufactured as stamped parts, the double flange $\mathbf{1}^2$ as a stamped bent part. Manufacture as a forging is another possibility.

REFERENCE NUMERAL LIST

1 engine flange
$\mathbf{1}^1$ single flange
$\mathbf{1}^2$ double flange
2 outlet flange
3 manifold pipe
4 inlet housing
5 inlet opening
6 outlet opening
7 flange section
8 connection section

The invention claimed is:

1. A single-wall manifold comprising:

an engine flange;

an outlet flange;

manifold pipes which are connected at their one end to the engine flange and at their other end to the outlet flange; and a load-transferring connection provided between the engine flange and the outlet flange in addition to the manifold pipes, the load-transferring connection formed such that a thermal compensation movement is made possible between the engine flange and the outlet flange and wherein the manifold pipes are flexible.

2. A single-wall manifold in accordance with claim 1, wherein the connection has a swept shape.

3. A single-wall manifold in accordance with claim 1, wherein the engine flange, on the one hand, and the outlet flange, on the other hand, are produced as separate parts and are subsequently connected to one another.

4. A single-wall manifold in accordance with claim 3, wherein the engine flange is made from a different material than the outlet flange.

5. A single-wall manifold in accordance with claim 1, wherein the engine flange is made from a high-quality steel, and the outlet flange is made from a less high-quality steel.

6. A single-wall manifold in accordance with claim 1, wherein the engine flange and the outlet flange are directly connected to one another.

7. A single-wall manifold in accordance with claim 1, wherein the connection is formed by a separate part which is connected to the engine flange and to the outlet flange.

8. A single-wall manifold in accordance with claim 1, wherein the engine flange is made of a plurality of single flanges and or double flanges.

9. A single-wall manifold in accordance with claim 8, wherein only some of of the single or double flanges are connected to the outlet flange.

10. A single-wall manifold in accordance with claim 1, wherein the manifold pipes are made flexible by selection of any one of the following, material, wall thickness, cross-sectional shape, or pipe curvature or any combination thereof.

11. A single-wall manifold in accordance with claim 1, wherein the flanges are formed as as a stamped part, as a stamped bent part or as a forging.

12. A single-wall manifold in accordance with claim 2, wherein the swept shape is an S shape.

13. A single-wall manifold in accordance with claim 5, wherein the high-quality steel is austenitic steel, and the less high-quality steel is ferritic steel.

14. A single-wall manifold in accordance with claim 6, wherein the engine flange and the outlet flange are directly connected to one another by welding.

15. A single-wall manifold in accordance with claim 7, wherein the connection is formed by a separate part which is connected by welding.

* * * * *